US005939963A

United States Patent [19]

Harcombe

[11] Patent Number: 5,939,963

[45] Date of Patent: Aug. 17, 1999

[54] ELECTROMAGNETIC ACTUATOR

[75] Inventor: Anthony Thomas Harcombe, Richmond, United Kingdom

[73] Assignees: Lucas Industries, United Kingdom; Caterpillar Inc., Peoria, Ill.

[21] Appl. No.: 08/977,490

[22] Filed: Nov. 24, 1997

[30] Foreign Application Priority Data

Nov. 30, 1996 [GB] United Kingdom ..... 9625000

[51] Int. Cl.[6] ..... H01F 7/08

[52] U.S. Cl. ..... 335/220; 335/228

[58] Field of Search ..... 335/220, 228, 335/229, 278, 281, 282, 297; 251/129.01, 129.15, 129.16

[56] References Cited

U.S. PATENT DOCUMENTS

| | | | |
|---|---|---|---|
| 4,924,126 | 5/1990 | Isozumi | 310/83 |
| 5,608,368 | 3/1997 | Ricco et al. | 335/281 |
| 5,608,369 | 3/1997 | Irgens et al. | 335/281 |

*Primary Examiner*—Lincoln Donovan
*Attorney, Agent, or Firm*—Ryndak & Lyerla

[57] ABSTRACT

An electromagnetic actuator assembly is described which comprises a stator housing having a slot extending across the diameter thereof. A stator core is located within the slot, the core carrying a coil. The core is conveniently shaped to permit the use of an increased diameter coil and to increase the area of the pole faces of the core.

15 Claims, 4 Drawing Sheets

FIG 8
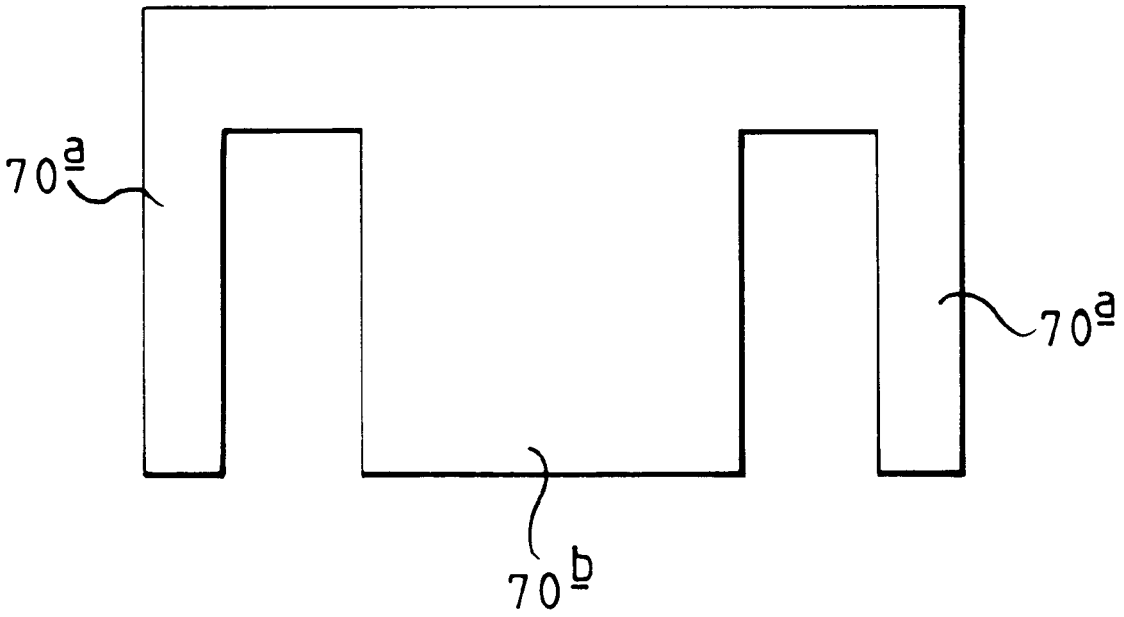
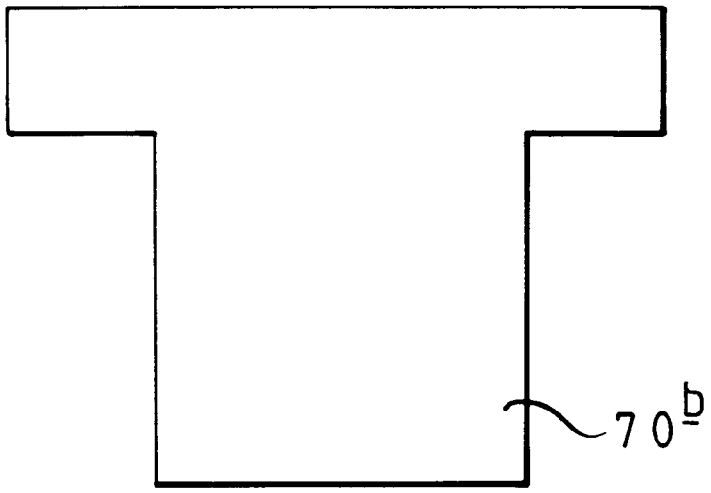
FIG 9

ELECTROMAGNETIC ACTUATOR

This invention relates to an electromagnetic actuator suitable for use in controlling the operation of a valve of a piece of fuel injection equipment. A valve incorporating such an electromagnetic actuator may be used in controlling the operation of an injector for use in supplying fuel to a cylinder of an associated internal combustion engine.

A known electronic unit injector comprises a nozzle body defining a bore within which a valve needle is slidable. The valve needle is spring biased into engagement with a seating. The valve needle defines one or more thrust surfaces oriented such that the application of fuel at high pressure thereto through a suitable supply line acts to lift the valve needle against the action of the spring away from the seating. High pressure fuel is also supplied to a chamber defined, in part, by a surface of the needle or an element carried by the needle, the application of high pressure fuel to the chamber assisting the spring. An electromagnetically actuated valve communicates with the chamber and is arranged to control the supply of fuel at high pressure thereto. The chamber communicates with a low pressure drain through a restricted passage, thus the pressure within the chamber falls to a relatively low level when the electromagnetically actuated valve prevents fuel from being supplied to the chamber.

In use, when the electromagnetically actuated valve is open, the pressure within the chamber is substantially equal to that applied to the thrust surface(s). The difference in the effective areas of the thrust surface(s) and the surface located within the chamber is such that the net force applied to the needle, both due to the application of fuel at high pressure and due to the action of the spring, maintains the needle in engagement with its seating. When injection is to commence, the electromagnetically actuated valve is closed, resulting in the pressure within the chamber falling to an extent sufficient to allow the valve needle to lift from its seating. In order to terminate injection, the electromagnetically actuated valve is opened causing the pressure within the chamber to increase, the increased pressure being sufficient to return the valve needle into engagement with its seating.

As shown in FIG. 1, the electromagnetic actuator includes a core 10 which is of substantially cylindrical shape, having an outer, annular pole 10*a*, and a central pole 10*b*. A coil 16 is wound around the central pole 10*b*. The core 10 is housed within a bore provided in a stator housing 12 which includes a drilling 14 forming part of a supply line whereby fuel is supplied to the needle. The presence of the supply line results in the dimensions of the electromagnetic actuator being restricted. If the dimensions of the actuator are increased, the application of fuel at high pressure to the supply line may result in the stator housing breaking.

Objects of the invention are to provide an electromagnetic actuator of increased pole area, the actuator being housed, in use, in a stator housing which is not of significantly increased dimensions. The invention also relates to an injector incorporating such an electromagnetic actuator. It is also an object of the invention to provide an electromagnetic actuator for an injector having an increased pole area but without excessively weakening the part of the stator housing defining the supply line.

According to the present invention there is provided an electromagnetic actuator assembly comprising a stator housing, a stator core located within a slot extending across the diameter of the stator housing, the stator core carrying a coil, and an armature moveable under the influence of a magnetic field generated by the stator core and coil, in use.

By locating the core in a slot extending across the diameter of the stator housing, and by using an appropriately shaped core, a larger coil can be used than is the case where the core is located within a bore provided in the stator housing without increasing the dimensions of the stator housing or excessively weakening the stator housing around the supply line. Further, the area of the stator pole faces can be increased.

The invention further relates to an injector including a control chamber, and a valve arranged to control the fuel pressure within the control chamber, the valve being actuated by an electromagnetic actuator assembly of the type defined hereinbefore.

It will be appreciated that the electromagnetic actuator assembly of the invention is suitable for use in hydraulic switching valves, for example for use in unit pump/injector arrangements and unit pump arrangements, but that the description herein should not be taken to limit the invention to electromagnetic actuator assemblies for use in such arrangements.

The invention will further be described, by way of example, with reference to the accompanying drawings, in which.

Figure 3:
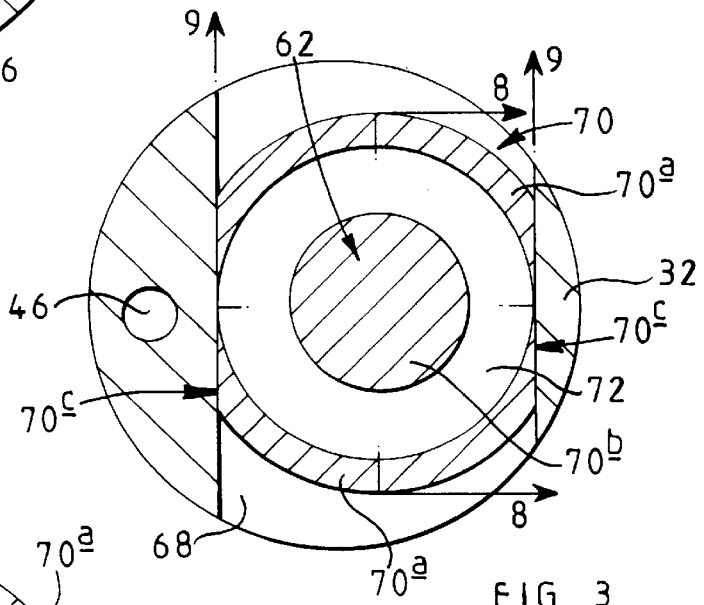
FIG. 3 is a view similar to FIG. 1 of the actuator assembly used in the injector of FIG. 2.

FIGS. 4 to 7 are views similar to FIG. 3 of alternative arrangements; and FIGS. 8 and 9 are sectional views along the lines 8—8 and 9—9 of FIG. 3, respectively.

Figure 2:
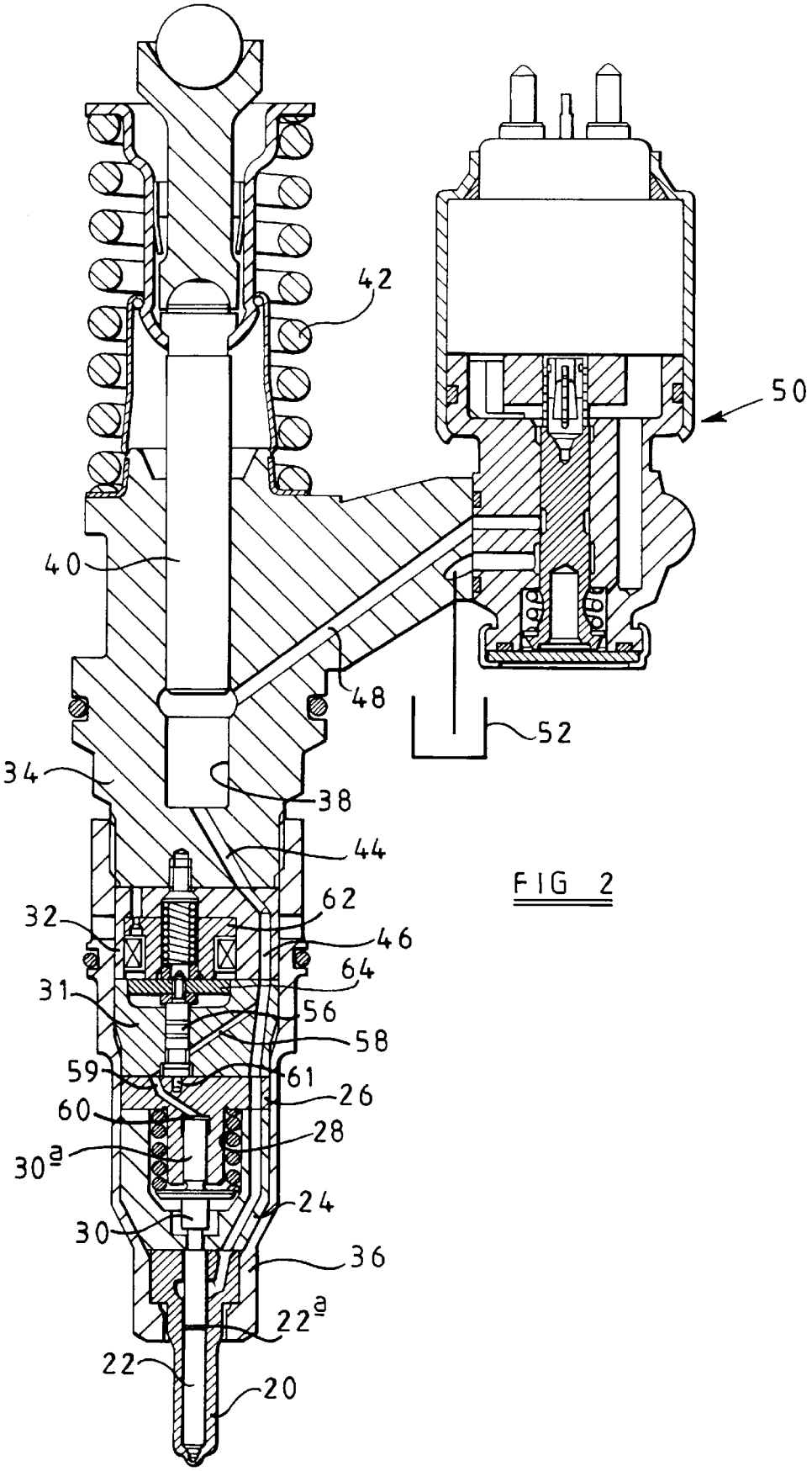
FIG. 2 is a sectional view of an injector incorporating an electromagnetic actuator assembly in accordance with an embodiment of the invention.

The injector illustrated in FIG. 2 is a unit pump/injector which comprises a nozzle 20 provided with a blind bore within which a valve needle 22 is slidable. The valve needle is engageable with a seating located adjacent the blind end of the bore. The nozzle 20 is provided with a plurality of outlet apertures which communicate with the blind bore downstream of the seating.

The nozzle 20 abuts a first distance piece 24 which, in turn, abuts a second distance piece 26. The first distance piece 24 is provided with a through bore which is coaxial with the bore of the nozzle 20 and which includes a region of enlarged diameter which defines a spring chamber 28. A helical spring is located within the spring chamber 28 and is engaged between the second distance piece 26 and a spring abutment 30 carried by the valve needle 22, the spring biasing the valve needle towards the seating.

The second distance piece 26 abuts a valve housing 31 which in turn abuts a stator housing 32. The stator housing 32 abuts a pump housing 34. A cap nut 36 secures the nozzle 20, first and second distance pieces 24, 26 and valve and stator housings 31, 32 to the pump housing 34. The pump housing 34 includes a bore 38 within which a pumping plunger 40 is reciprocable under the influence of a cam arrangement against the action of a spring 42. The bore 38 communicates through a drilling 44 with a drilling 46 provided in the stator housing 32 which communicates with drillings provided in the valve housing 31, first and second distance pieces 24, 26 and nozzle 20 to supply fuel to the bore of the nozzle 20 towards the seating thereof. The valve needle 22 includes an angled thrust surface 22*a* oriented such that the application of fuel at high pressure to the bore results in a force being applied to the needle 22 acting against the action of the spring.

The bore 38 communicates through a passage 48 with an electromagnetically actuated spill valve 50 which controls communication between the passage 48 and a passage which communicates with a low pressure reservoir 52.

The valve housing 31 is provided with a through bore, a control valve member 56 being slidable within the through bore and engageable with a seating to control communication between a drilling 58 which communicates with the drilling 46, and a passage 59 which communicates with a control chamber 60 defined by a blind bore provided in the second distance piece 26 within which an extension 30*a* of the spring abutment 30 is slidable in a piston-like manner. The control valve member 56 further controls communication between the chamber 60 and a passage 61 which communicates with a low pressure drain or reservoir. Clearly, when the pressure within the control chamber 60 is high, a relatively high force is applied to the extension 30*a*, and hence to the valve needle, in a direction assisting the spring, the magnitude of the force being reduced when the control chamber 60 is at a lower pressure.

In order to control movement of the control valve member 56, an electromagnetic actuator is provided in the injector, the actuator comprising a stator 62 rigidly mounted within the stator housing 32, and an armature 64 which is moveable under the influence of the magnetic field generated by the stator 62, in use. The armature 64 is rigidly secured to the control valve member 56.

Figure 1:
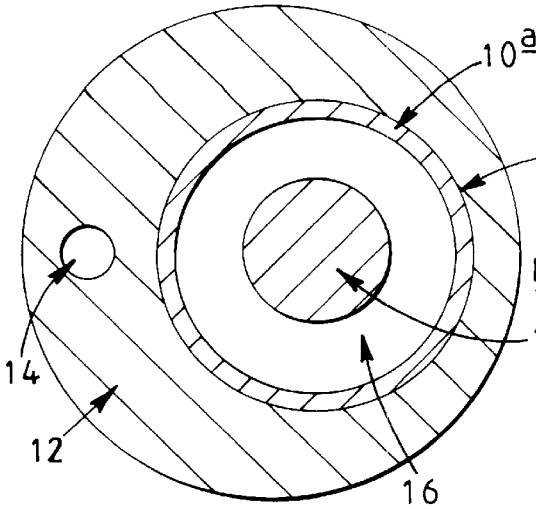
FIG 1 PRIOR ART
FIG. 1 is a diagrammatic cross-sectional view of part of a conventional electromagnetic actuator assembly.

As shown in FIG. 3, the stator 62 is located within a slot 68 which extends across the full diameter of the stator housing 32. The stator 62 comprises a core member 70 which includes an outer, annular pole 70*a* and an inner pole 70*b* of circular cross section. The diameter of the outer pole 70*a* is greater than the width of the slot 68, thus in order to permit the core member 70 to fit within the slot 68, the core member 70 is shaped so as to include flats 70*c*. A coil 72 is wound around the inner pole 70*b*, and in order to maximize the diameter of the coil 72, the outer diameter of the coil 72 is very slightly smaller than the width of the slot 68. The inner pole 70*b* is of larger diameter than in the case illustrated in FIG. 1. In order to ensure that the increased pole area is fully utilized, the outer pole 70*a* is also of increased area. The increase in pole area compared with the arrangement illustrated in FIG. 1 is advantageous in that a larger force can be applied to the armature 64 without increasing the diameter of the injector.

The core member 70 may be constructed using a number of techniques, for example by sintering.

Although FIG. 3 illustrates the inner pole 70*b* as being solid, it will be appreciated that in the injector illustrated in FIG. 2, the centre pole 70*b* is hollow in order to permit the control valve member 56 to extend therethrough.

In the position illustrated in FIG. 2, the pumping plunger 40 occupies its fully withdrawn position, and the bore 38 is charged with fuel at relatively low pressure. The spill valve 50 is open permitting communication between the passage 48 and the low pressure drain 52, and control valve member 56 occupies a position in which the control chamber 60 communicates with the bore 38. Inward movement of the pumping plunger 40 results in fuel being displaced from the bore 38 through the spill valve 50 to the low pressure reservoir. As the control chamber 60 communicates with the bore 38, the pressure within the control chamber 60 is substantially equal to that within the bore of the nozzle 20, and under these circumstances, the forces applied to the needle 22 due to the spring and the fuel pressure within the bore and control chamber 60 result in the needle engaging its seating.

A predetermined time before injection is to commence, the spill valve 50 is actuated to break the communication between the passage 48 and the low pressure drain 52. As the fuel can no longer flow through the spill valve 50, continued inward movement of the pumping plunger 40 pressurizes the fuel within the chamber 38. The pressure within the control chamber 60 remains substantially equal to that within the bore of the nozzle 20 due to the communication therebetween, thus the needle 22 remains in engagement with its seating.

In order to commence injection, the coil 72 is energized, thus moving the control valve member 56 to a position in which the communication between the control chamber 60 and the bore 38 is broken, and instead, the control chamber 60 communicates with the low pressure drain, thus the pressure within the control chamber 60 falls. The reduced pressure within the control chamber results in a sufficiently reduced force being applied to the needle 22 to permit the needle 22 to be lifted from its seating against the action of the spring.

To terminate injection, the coil 72 is de-energized, to permit the control valve member 56 to move to its original position. Such movement breaks the communication between the control chamber 60 and the low pressure drain, the control chamber 60 instead communicating with the bore 38. The pressure within the control chamber 60 therefore rises to a sufficient extent to return the needle 22 into engagement with its seating.

Where the pump/injector is operated in such a manner as to achieve a pilot injection followed by a main injection, the main injection is initiated and terminated by re-energizing the coil 72 and subsequently de-energizing the coil 72.

After, or almost simultaneously with, termination of injection, the spill valve 50 is de-energized, resulting in fuel flowing past the spill valve 50 to the low pressure reservoir, and hence in the pressure within the bore 38 falling. Continued inward movement of the pumping plunger 40 displaces further fuel from the bore 38 to the low pressure reservoir.

After inward movement of the plunger has been completed, the plunger is returned to the position shown under the action of the spring 42, such outward movement of the plunger 40 drawing fuel into the bore 38 from the reservoir past the spill valve 50. The pump/injector is then ready for commencement of the next injection cycle.

Figure 4:
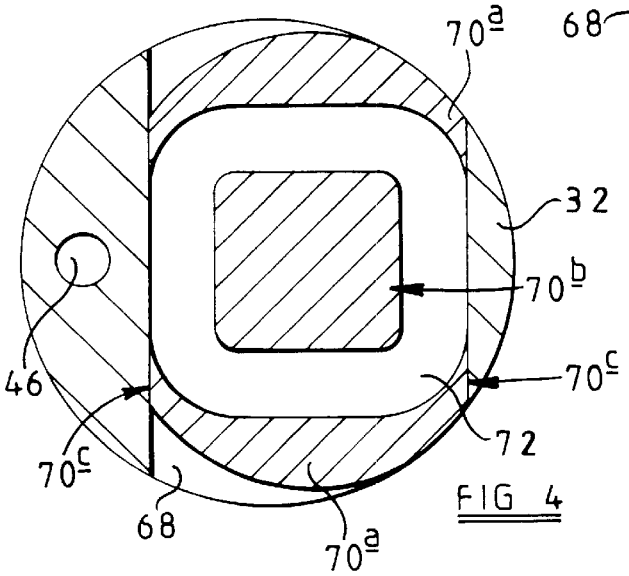

FIG. 4 illustrates an alternative stator construction in which the inner pole 70*b* is of substantially square cross-section, the outer pole 70*a* comprising a pair of elements of part crescent shape. As in the arrangement illustrated in FIG. 3, the width dimension of the coil 72 is very slightly smaller than the width of the slot 68, and the outer pole 70*a* is provided with flats 70*c* in order to permit the core member 70 to fit within the slot 68. The use of the stator arrangement of FIG. 4 further increases the area of the pole faces without increasing the diameter of the injector. Clearly, the substantially square inner pole could be replaced by a pole of substantially rectangular section.

Figure 5:
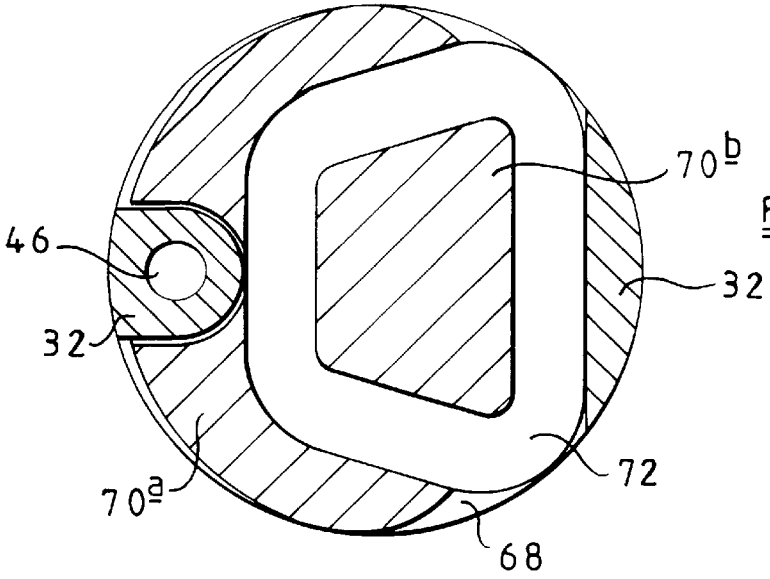

FIG. 5 illustrates an arrangement in which, in order to further increase the area of the pole faces, rather than provide a slot of uniform cross section, the slot is shaped so as to extend around the part of the stator housing 32 within which the drilling 46 is provided, whilst maintaining a sufficiently high wall thickness to withstand the fuel pressure within the drilling 46, in use. The increased area available permits the stator to take a number of forms, the stator of the FIG. 5 arrangement including a first pole member 70*b* of generally trapezoidal shape around which a coil 72 is wound, and a second pole member 70*a* located so as to extend adjacent three sides of the coil 72.

Figure 6:
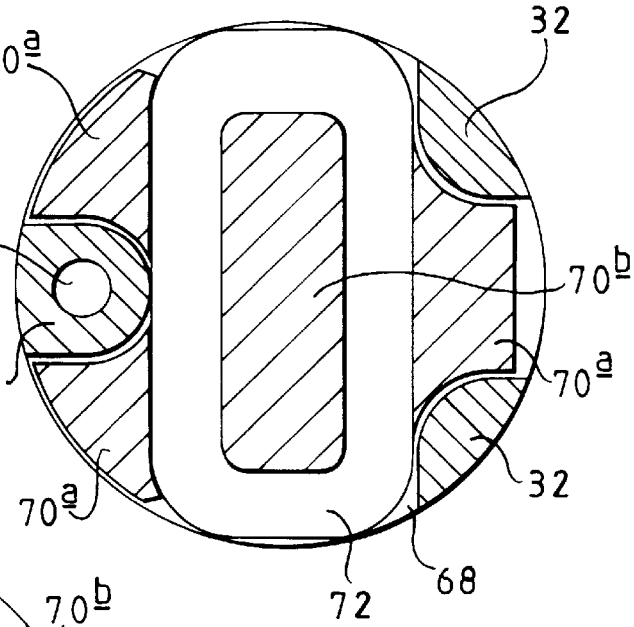

The arrangement illustrated in FIG. 6 provides an even greater pole area by providing an opening in the wall of the stator housing 32 opposite the drilling 46. In this embodiment, the first pole 70*b* is of generally rectangular shape, the second pole 70*a* extending around part of the wall defining the drilling 46, and extending within the opening provided in the wall of the stator housing 32 opposite the drilling 46.

Although the arrangements described with reference to FIGS. 3 to 6 provide an increased pole area, and hence permit the application of a greater force to the armature without increasing the dimensions of the injector, the arrangements are unbalanced in the sense that the centre of effort of each stator will probably be eccentric to the outer diameter of the stator housing. This is certainly true of the arrangements of FIGS. 3 and 4, and is probably the case with the arrangements of FIGS. 5 and 6, depending upon the exact construction.

Whilst this may be acceptable in some applications, it is usually preferable for the centre of effort to be coaxial with the centreline of the valve or the like to be actuated. This may be achieved by adjusting the position of the valve. Alternatively, where it is preferred to locate the valve on the main axis of the device, for example injector, the shape and disposition of the pole faces and/or the armature, can be adjusted so that the centre of effort also lies substantially on the axis. The force which can be applied by the actuator may be reduced as a result.

Figure 7:
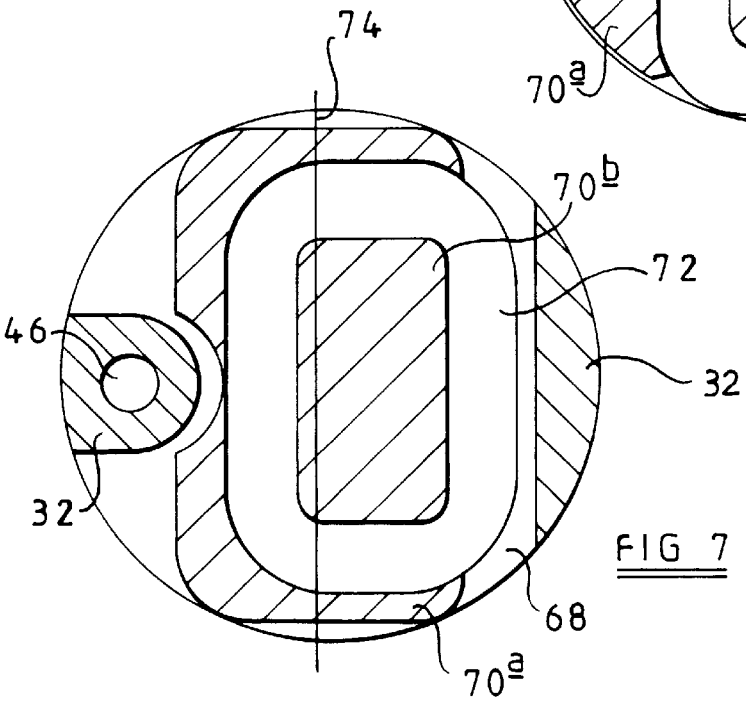

FIG. 7 illustrates an arrangement in which the shape of the pole faces has been adjusted in order that the sum of the moments of area from the pole faces is substantially zero. This approach assumes that the force is generated uniformly over the poles faces; of course, if the generated force over the pole faces is not uniform, some further refining of the shape of the pole faces may be required, for example using empirical or more sophisticated analytical means.

FIGS. 8 and 9 illustrate that the inner and outer poles of the FIG. 3 arrangement form part of a single core member, the inner and outer poles being integrally interconnected with one another by an upper part 70*d*. It will be appreciated that the same is true of the other embodiments.

It will be appreciated that the invention is applicable to injectors other than the type described hereinbefore with reference to FIG. 2, and also that the invention should not be restricted to the examples of stator arrangements described hereinbefore. Further, the electromagnetic actuator is suitable for use in controlling electromagnetically actuated hydraulic switching control valves for use in fuel injection equipment applications other than fuel injectors.

I claim:

1. An electromagnetic actuator comprising a stator housing having a circumference, a slot provided in the stator housing and extending across a full diameter thereof, the slot including first and second ends which open into the circumference of the stator housing, a stator core located within the slot and carrying a coil, and an armature moveable under the influence of a magnetic field generated by the stator core and coil.

2. An electromagnetic actuator assembly as claimed in claim 1, wherein the stator core is shaped so that at least one side region of the coil is exposed to an adjacent side of the slot.

3. An electromagnetic actuator assembly as claimed in claim 2, wherein the slot has a width and the coil has a width substantially equal to the width of the slot.

4. An electromagnetic actuator assembly as claimed in claim 1, wherein the stator core comprises a generally cylindrical inner pole and a generally cylindrical outer pole, the outer pole being of diameter greater than the width of the slot, the outer pole being provided with flats enabling the stator core to be received within the slot.

5. An electromagnetic actuator assembly as claimed in claim 1, wherein the stator core comprises an inner pole piece of generally rectangular shape and a pair of generally crescent shaped outer pole pieces.

6. An electromagnetic actuator assembly as claimed in claim 1, wherein the stator core comprises an inner pole of trapezoidal form, and an outer pole piece which extends adjacent three sides of the coil.

7. An electromagnetic actuator assembly as claimed in claim 1, wherein the stator core includes inner and outer pole pieces which are shaped so that the sum of the moments of area of the pole faces is substantially zero.

8. A stator core adapted for use in an electromagnetic actuator assembly of the type claimed in claim 1.

9. A stator core as claimed in claim 8, which is shaped so that at least one side region of the coil is exposed to the sides of the slot.

10. A stator core as claimed in claim 8, comprising a generally cylindrical inner pole and a generally cylindrical outer pole, the outer pole being provided with flats.

11. A stator core as claimed in claim 8, comprising an inner pole piece of generally rectangular shape and a pair of generally crescent shaped outer pole pieces.

12. A stator core as claimed in claim 8, comprising an inner pole of trapezoidal form, and an outer pole piece which extends adjacent three sides of the coil.

13. A stator core as claimed in claim 8, including inner and outer pole pieces which are shaped so that the sum of the moments of area of the pole faces is substantially zero.

14. A fuel injector comprising a control chamber and a valve arranged to control the fuel pressure within the control chamber, the valve being actuable under the control of an electromagnetic actuator assembly as claimed in claim 1.

15. An electromagnetic actuator assembly for a fuel injector, the electromagnetic actuator assembly comprising a stator housing provided with a drilling forming part of a fuel supply line of the injector, a slot provided in the stator housing extending across a full diameter thereof, a stator core located within the slot and carrying a coil, and an armature moveable under the influence of a magnetic field generated by the core and coil, in use, the slot being shaped and located to ensure that the part of the stator housing within which the drilling is located is of sufficient thickness to withstand the application of high pressure fuel to the supply line.

* * * * *